United States Patent [19]

Mann et al.

[11] 4,351,371

[45] Sep. 28, 1982

[54] APPARATUS FOR PRODUCING COILS

[75] Inventors: Friedrich Mann, Nuertingen; Guido Negro, Neuffen, both of Fed. Rep. of Germany

[73] Assignee: Bielomatik Leuze GmbH + Co., Fed. Rep. of Germany

[21] Appl. No.: 260,310

[22] Filed: May 4, 1981

Related U.S. Application Data

[63] Continuation of Ser. No. 69,457, Aug. 24, 1979, abandoned.

[30] Foreign Application Priority Data

Aug. 31, 1978 [DE] Fed. Rep. of Germany ..... 2837918

[51] Int. Cl.[3] ..... B21F 3/02

[52] U.S. Cl. ..... 140/92.3

[58] Field of Search ..... 140/71 C, 92.3, 92.93, 140/92.94, 92.2, 92.4; 11/1 R, 1 AC; 91/2

[56] References Cited

U.S. PATENT DOCUMENTS

| | | | |
|---|---|---|---|
| 1,081,458 | 12/1913 | McKenney | 91/2 |
| 3,101,750 | 8/1963 | Pfaffle | 140/92.3 |
| 3,378,045 | 4/1968 | Thurman | 140/92.2 |
| 3,520,334 | 7/1970 | Mueller | 140/92.3 |
| 3,818,954 | 6/1974 | Pfaffle | 140/92.3 |

*Primary Examiner*—John McQuade

*Attorney, Agent, or Firm*—Steele, Gould & Fried

[57] ABSTRACT

An apparatus for introducing a coiled binding wire directly into a row of holes in a pack of sheets comprises a pneumatic motor connected directly to a winding spindle which coils the binding wire and introduces the coil into the row of holes, the motor driving the spindle intermittently. A valve for controlling the air supply to the motor is arranged fast therewith.

6 Claims, 1 Drawing Figure

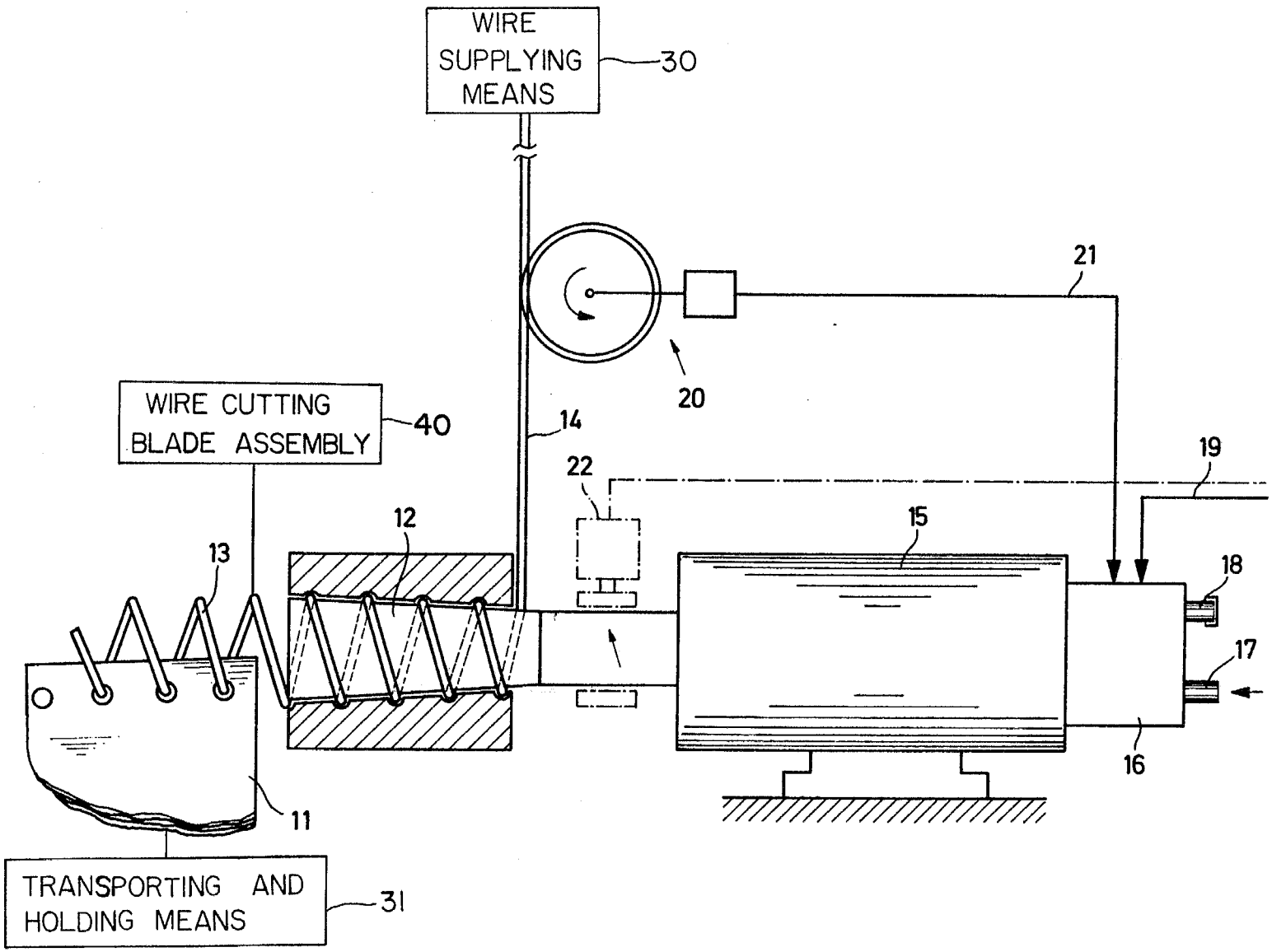
WIRE SUPPLYING MEANS
30
20
21
19
18
17
16
15
22
14
12
40
WIRE CUTTING BLADE ASSEMBLY
13
11
31
TRANSPORTING AND HOLDING MEANS

APPARATUS FOR PRODUCING COILS

This is a continuation of application Ser. No. 69,457 filed Aug. 24, 1979, now abandoned.

FIELD OF THE INVENTION

The invention relates to an apparatus for producing coils in the course of a process for the production of binding coils which are to be introduced directly into a row of holes in a pack of sheets, the apparatus having a winding spindle which is driven intermittently by a motor.

BACKGROUND OF THE INVENTION

Packs of sheets which are held together in this way by a coil made of metal or plastic wire are used, for example as shorthand pads and calenders. The production and the insertion of the coils take place in a so-called spiralling unit by means of a winding tool which is accelerated with the aid of a braking motor, i.e., an electric motor which can be switched very frequently between an 'off' condition in which it is at a standstill and an 'on' condition in which it rotates at its rated speed of about 6500 revolutions per minute. The motor winds the coil and inserts it into the pack of sheets with the aid of pivotal guide rollers. The winding tool is then braked to a standstill by the braking motor, the spirals cut to length and both ends bent back. This mode of operation is described in German Pat. No. 1,008,708.

As already mentioned in German Pat. No. 19 44 223, the performance, i.e. the number of strokes, of this known apparatus cannot be increased at will. As the winding tool can only operate during the time in which the pack of sheets is available in the spiralling unit and, moreover, time has to be allowed for cutting and bending back the ends the actual spiralling has to be carried out in a very short time. In practice, the processes described above are controlled by a timing shaft, which performs one revolution per operating process. There are only about 200° available on the timing shaft, i.e. only about 55% of the clock time, for the actual formation of the coil, i.e. the starting up of the winding tool, the formation and the insertion of the coil and the braking of the winding tool. This means that only just over a second remains for the spiralling operation with a clock time of the machine of 30 operations per minute. Although the proportional spiralling time could be increased to 240° on the timing shaft and thus the clock time to 35 operations per minute by reducing the other times in the intermediate period, a limit would be reached which restricted the performance of the entire apparatus and therefore sometimes an entire production line.

It is also mentioned in German Pat. No. 19 44 223, that attempts to increase the operating speed by means of electric motors having higher performances have not been successful because the advantages of their high performance are cancelled out by their high moment of inertia. Moreoever, tests have already been carried out using mechanical or electromagnetic couplings which turn on a continuously running drive means. These have not allowed adequate working lives to be obtained owing to the high amount of wear.

German Pat. No. 19 44 223 was therefore based on the mechanically very simple direct insertion of the coil into the pack of sheets and the spirals were produced continuously, then stored in the intermediate period and wound into the block by a special insertion device. Although higher operating speeds can be achieved in this way, this is at the expense of a mechanically more complicated system.

BRIEF SUMMARY OF THE INVENTION

The object of the invention is therefore to provide an apparatus which allows the direct insertion of a coil into the pack of sheets but nevertheless allows the operating speeds to be increased.

According to the invention there is provided an apparatus for the production of coils in the course of a process for introducing a coiled binding wire directly into a row of holes in a pack of sheets, the apparatus comprising a winding spindle and a pneumatic motor for intermittently driving the winding spindle, the motor being connected directly to the winding spindle.

A pneumatic motor of this type, preferably a rotating piston air motor, allows the winding spindle to be accelerated to 12,000 revolutions per minute in about 0.3 seconds and to be brought to a standstill again with a braking time of about 0.15 seconds. More than 63 operation strokes per minute can be achieved in this way, i.e. almost double the performance achieved with known apparatus. Another advantage lies in the simple design which is possible as the winding spindle can be joined directly to the motor shaft. A variable speed drive is not needed as the control can be effected directly by means of the air supply. A separate bearing for the winding tool can be dispensed with, as can transmission arrangements connected upstream.

When considering these advantages, it may look as though it would have been clear that a pneumatic motor would be particularly suitable for this application. In fact however, although these advantages could be determined experimentally, there were initially doubts about them. As the spiralling operation begins as soon as the winding spindle is turned, the starting torque is very high in addition to the considerable forces of acceleration. It is however relevant for pneumatic motors, in particular for rotating piston air motors, that they can have problems in starting under heavy loads. In addition, certain delays in starting occur with pneumatic motors because, in most cases, again particularly with rotating piston air motors, the closeness of the inner piston disc has to be produced by applying the pressure before the motor can start up completely. Consequently, these pneumatic motors have not hitherto normally been used in the case of short intermittent operation with short starting and braking times.

It has however been found that these disadvantages do not arise owing to the cooperation of the pneumatic motor with the special winding process. A possible explanation for this may be that the winding spindle initially has a very small angle of rotation in which it can be rotated almost without load before the complete load is applied. If the opening and closing valve is arranged close to the pneumatic motor, i.e. the air space located between the motor and valve is as small as possible, this promotes particularly rapid start up and braking.

In an arrangement with the above-mentioned performance data, a pneumatic motor is braked by the wire forming the coil when the air supply is cut off by means of the valve. In certain applications, the braking time which is already extremely short can be further reduced by applying a counter-pressure to the pneumatic motor in order to stop the motor. The running time can also be further reduced if, in a further improved embodiment, the pneumatic motor is provided with an arresting means which can be released under control and is charged with compressed air before the arresting means is released. In this case therefore, an arresting means for example a mechanical brake, is switched on in the standstill phase after the braking, and compressed air is then charged into the motor so that, on the one hand, the pressure build up phase is dispensed with and, on the other hand, the sealing elements are already placed in the pneumatic motor. The pneumatic motor runs with an even shorter start up time after being started by releasing the arresting means.

Although the beginning of the spiralling operation is normally controlled by the machine and can be effected, for example by actuating mechanical or electric valves, the valve is preferably controlled by means of a wire length measuring instrument so as to switch off the pneumatic motor at the correct moment.

BRIEF DESCRIPTION OF THE DRAWINGS

The drawing shows a schematic side view, in partial section, of an embodiment of a spiralling unit according to the invention.

DETAILED DESCRIPTION OF ILLUSTRATED EMBODIMENT

The spiralling unit, a detail of which is shown in the drawing, is normally a component of an entire machine for the production of blocks or the like. A pre-perforated pack of sheets 11 is introduced into the spiralling unit by transporting and holding means 31 positioned upstream of a winding spindle 12, which is frustoconical and cooperates with a surrounding sleeve (not shown in detail). Reference is made to German Pat. No. 11 89 513 for further details about the winding spindle.

The winding spindle serves to form a coil 13 of wire, for example a metal or plastic wire 14, which is supplied to the smaller internal diameter end of the winding spindle. The wire is supplied by a wire supplying means 30.

The winding spindle is joined directly to the shaft of a pneumatic rotating piston air motor of a design known per se, without the interposition of a transmission arrangement, switching couplings or the like. A pneumatic valve 16, for example an electrically switchable valve, is flanged directly onto the pneumatic motor 15, the valve being connected to a compressed air source 17 and having a means 18 for ventilation and delivery of the issuing air.

A starting signal which opens the valve is transmitted from the production machine, for example from its synchronising shaft, or as a function of the precise position of the pack of sheets 11, via a line 19 to the valve and causes the pneumatic motor 15 to start up immediately with the winding spindle 12. This produces the coil 13 which is immediately rotated into the row of holes in the pack of sheets. The wire 14 passes through a wire length measuring instrument which is represented as an odometer in this arrangement. After a predeterminable wire length, which corresponds to the wire length needed for the coil for the corresponding pack of sheets, a closing signal is transmitted by the wire length measuring instrument 20 via the line 21 to the valve 16, whereupon the valve blocks the compressed air supply and immediately stops the pneumatic motor, backed up by the tension of the wire 14 which is to be tightened.

The valve can also be designed in such a way that it switches over when it receives the closing signal and transmits a surge of pressure, which need only be short, in the direction of reverse travel to the pneumatic motor in order to accelerate the braking.

A modification is shown in dot dashed lines. In the modification, an arresting or braking device 22 is provided on the motor shaft or on the winding spindle and can regulate it. It is actuated while the pneumatic motor is at a standstill. Thereafter, while the motor is still at a standstill, the valve is opened and the arresting means 20 is finally released suddenly by the closing signal of the machine so that the pneumatic motor 15, which is already under pressure, starts up. The desired speed of the pneumatic motor can be adjusted by means of a control valve (not shown) in the compressed air supply 17.

It should be noted that the invention provides an apparatus which allows the performance to be almost doubled and which is at the same time designed in a particularly simple manner. It is possible to increase not only the performance of the spiralling unit but also the performance of the entire machine which has often been limited in performance only by the spiralling unit. A wire-cutting blade assembly 40, which does not form part of the invention, is provided in the spiralling unit between the winding spindle and the pack of sheets 11.

A pneumatic motor with a reducing gear, for example a gear fitted in the motor, can also be used so as to allow the use of particularly small pneumatic motors. This is also possible if the speed is to be restricted in the case of sensitive coil materials, for example plastic-coated steel wire.

We claim:

1. An improved apparatus for the production of wire coils for binding packs of sheets, the apparatus having a winding spindle for forming the coils, means for supplying the wire to the winding spindle, means for metering lengths of the wire, a pneumatic motor having a shaft for intermittently driving the winding spindle, means for transporting perforated packs of sheets to and from a position operationally adjacent the winding spindle, and means for holding the perforated packs of sheets in the operationally adjacent position during insertion of the wire coil, wherein the improvement comprises:

means for stopping the pneumatic motor in response to the metering means; and, a direct connection between the driving shaft and the winding spindle, without any intervening transmission or switch coupling, notwithstanding the intermittent operation, whereby a resulting low momentum drive arrangement takes advantage of elastic properties of the wire to provide a small angle through which the motor can begin rotating without experiencing the full load due to bending and transporting the wire, and the pneumatic motor is braked by the load due to mechanical resistance of the winding spindle after the motor is stopped.

2. An apparatus according to claim 1, wherein the pneumatic motor is a rotating piston air motor.

3. An apparatus according to claim 1, wherein a valve for opening and closing air communication with the pneumatic motor is arranged fast with the pneumatic motor.

4. An apparatus according to claim 1, further comprising a valve for opening and closing air communication with the pneumatic motor, the valve being controlled by the metering means.

5. An apparatus according to claim 1, comprising means for applying a counter-pressure to the pneumatic motor in order to stop the pneumatic motor.

6. An apparatus according to claim 1, further comprising an arresting means for stopping the pneumatic motor, which arresting means can be released under control, the pneumatic motor being chargeable with compressed air before the arresting means is released.

* * * * *